US011407021B2

(12) United States Patent
Nye et al.

(10) Patent No.: US 11,407,021 B2
(45) Date of Patent: Aug. 9, 2022

(54) FORMING FINISHED PARTS USING A MOVABLE GANTRY PRESS AND A PLURALITY OF DIE ASSEMBLIES

(71) Applicant: The Boeing Company, Chicago, IL (US)

(72) Inventors: Jeffrey Garn Nye, East Helena, MT (US); Dustin Alfred Nelson, Clancy, MT (US); Jason Paul Helland, Helena, MT (US); Brian William Ullman, Helena, MT (US); Craig Jenny, Roy, WA (US)

(73) Assignee: The Boeing Company, Chicago, IL (US)

( * ) Notice: Subject to any disclaimer, the term of this patent is extended or adjusted under 35 U.S.C. 154(b) by 334 days.

(21) Appl. No.: 16/540,718

(22) Filed: Aug. 14, 2019

(65) Prior Publication Data

US 2021/0046537 A1 Feb. 18, 2021

(51) Int. Cl.

| | |
|---|---|
| ***B21D 43/02*** | (2006.01) |
| ***B21D 22/02*** | (2006.01) |
| ***B21D 53/92*** | (2006.01) |

(52) U.S. Cl.

CPC ..... *B21D 43/02* (2013.01); *B21D 22/02* (2013.01); *B21D 53/92* (2013.01)

(58) Field of Classification Search

CPC ..... B21D 43/02; B21D 22/02; B21D 53/92; B21D 43/04; B21D 43/05; B21D 43/10; B21D 43/105; G05B 2219/45142

USPC ..... 72/306, 405.01, 405.09, 405.11, 405.12

See application file for complete search history.

(56) References Cited

U.S. PATENT DOCUMENTS

| | | | | |
|---|---|---|---|---|
| 3,974,673 | A | 8/1976 | Fosness et al. | |
| 7,128,869 | B2 * | 10/2006 | Habisreitinger | B29C 70/467 264/510 |
| 2011/0146854 | A1 | 6/2011 | Nasserrafi et al. | |
| 2012/0279271 | A1 * | 11/2012 | Carter | H05B 6/101 72/342.8 |
| 2013/0160511 | A1 * | 6/2013 | Huang | B21D 37/16 72/60 |

(Continued)

OTHER PUBLICATIONS

Extended European Search Report dated Dec. 22, 2020 for European Patent Application No. 20185152.4, 9 pages.

(Continued)

*Primary Examiner* — Jessica Cahill
*Assistant Examiner* — Smith Oberto Bapthelus
(74) *Attorney, Agent, or Firm* — Sage Patent Group

(57) ABSTRACT

Systems, devices, and methods for fabricating finished parts include a system that includes a plurality of die assemblies located at a plurality of respective locations, each die assembly being configured to fabricate a respective finished part. The system further includes a movable gantry press and a robot, each configured to move between the plurality of respective locations. The system further includes a controller configured to receive a input to fabricate a finished part and identify a die assembly of the plurality of die assemblies. The controller is further configured to instruct the movable gantry press and the robot to move to the location of the die assembly. The controller is further configured to instruct the robot to load a blank into the die assembly, and instruct the movable gantry press to operate the die assembly to fabricate the finished part.

19 Claims, 14 Drawing Sheets

(56) References Cited

U.S. PATENT DOCUMENTS

| | | | | |
|---|---|---|---|---|
| 2013/0276505 | A1 | 10/2013 | Kitai | |
| 2014/0090439 | A1* | 4/2014 | Huang | B21D 37/14 72/352 |
| 2020/0122215 | A1 | 4/2020 | Sanders et al. | |
| 2020/0122216 | A1 | 4/2020 | Sanders et al. | |

OTHER PUBLICATIONS

Olsson, Sture, "High Pressure Warm Forming Forms Aerospace Grade Titanium", Stamping Journal May/Jun. 2018; downloaded on Aug. 14, 2019 from: https://www.thefabricator.com/article/stamping/high-pressure-warm-forming-forms-aerospace-grade-titanium.

Shelton, Gary, Roller Screw Actuators: Benefits, Selection and Maintenance:, Design World Jun. 10, 2010; downloaded on Aug. 14, 2019 from: https://www.designworldonline.com/roller-screw-actuators-benefits-selection-and-maintenance/.

Vector Tooling Technologies, "Hot Form Dies"; downloaded on Aug. 14, 2019 from: https://www.vec-tec.com/hot-form-dies1.html.

* cited by examiner

FORMING FINISHED PARTS USING A MOVABLE GANTRY PRESS AND A PLURALITY OF DIE ASSEMBLIES

FIELD

Embodiments described herein relate to forming finished parts, and more particularly to forming finished parts using a movable gantry press and a plurality of die assemblies, and related systems, devices, and methods.

BACKGROUND

Finished parts for aircraft and other applications may be formed in a number of ways, including creep forming, milling, machining, or performing other processes on one or more blanks. As the size and complexity of these parts increase, conventional processes become less efficient and lead to increases in cost, complexity and production time. For example, forming a splice plate or other large angled part for a modern aircraft may require creep forming a relatively thick metal (e.g. titanium) blank and milling the finished part out of the blank, which results in more milling time, higher raw material costs, higher waste, and requires more capital and recurring costs. Thus, there is a need for improved systems, devices, and methods for forming finished parts for these and other applications.

SUMMARY

In accordance with an embodiment, a system for fabricating finished parts comprises a plurality of die assemblies located at a plurality of respective locations, each die assembly being configured to fabricate a respective finished part. The system further comprises a movable gantry press configured to move between the plurality of respective locations and selectively operate the plurality of die assemblies. The system further comprises a first robot configured to move between the plurality of respective locations and load a respective blank into each die assembly of the plurality of die assemblies. The system further comprises a controller configured to receive a first input to fabricate a first finished part, and identify a first die assembly of the plurality of die assemblies. The controller is further configured to instruct the movable gantry press to move to the location of the first die assembly, and instruct the first robot to move to the location of the first die assembly. The controller is further configured to instruct the first robot to load a first blank into the first die assembly, and instruct the movable gantry press to operate the first die assembly to fabricate the first finished part.

In accordance with an embodiment and any of the preceding embodiments, the system further comprises a press rail system, the movable gantry press configured to traverse the press rail system to access each die assembly of the plurality of die assemblies.

In accordance with an embodiment and any of the preceding embodiments, the system further comprises a robot rail system, the first robot configured to traverse the robot rail system to access each die assembly of the plurality of die assemblies.

In accordance with an embodiment and any of the preceding embodiments, the system further comprises a second robot configured to move between the plurality of respective locations and remove the respective finished part from each die assembly of the plurality of die assemblies. The controller is further configured to instruct the second robot to move to the location of the first die assembly, and instruct the second robot to remove the first finished part from the first die assembly.

In accordance with an embodiment and any of the preceding embodiments, the controller is further configured to receive a second input to fabricate a second finished part, and identify a second die assembly of the plurality of die assemblies. The controller is further configured to instruct the movable gantry press to move to the location of the second die assembly, and instruct the first robot to move to the location of the second die assembly. The controller is further configured to instruct the first robot to load a second blank into the second die assembly, and instruct the movable gantry press to operate the second die assembly to fabricate the second finished part.

In accordance with an embodiment and any of the preceding embodiments, the first finished part has a first shape and the second finished part has a second shape different from the first shape.

In accordance with an embodiment and any of the preceding embodiments, each die assembly comprises an upper die section and a lower die section. The movable gantry press is further configured to, in response to being instructed to operate the first die assembly, lift the upper die section of the first die assembly, after the first robot has loaded the first blank into the first die assembly, lower the upper die section of the first die assembly, and actuate an actuator of the movable gantry press to compress the first blank between the upper die section and the lower die section of the first die assembly to fabricate the first finished part.

In accordance with an embodiment and any of the preceding embodiments, each upper die section of each die assembly comprises a plurality of upper die segments, and each lower die section of each die assembly comprises a plurality of lower die segments.

In accordance with an embodiment and any of the preceding embodiments, the actuator of the movable gantry press further comprises at least one electric motor, and at least one ballscrew configured to be driven by the at least one electric motor to, for each die assembly, apply a force to the upper die section to compress the respective blank between the upper die section and the lower die section of the die assembly.

In accordance with an embodiment and any of the preceding embodiments, the system further comprises a plurality of heating elements disposed in the plurality of die assemblies, the plurality of heating elements configured to, for each die assembly, heat at least one of an upper die section or a lower die section of the die assembly to at least a predetermined temperature.

In accordance with an embodiment and any of the preceding embodiments, the predetermined temperature is at least about 900 degrees F.

In accordance with an embodiment and any of the preceding embodiments, a method for forming finished parts comprises receiving, at a controller, a first input to fabricate a first finished part, and identifying, by the controller, a first die assembly of a plurality of die assemblies located at a plurality of respective locations, each die assembly being configured to fabricate a respective finished part. The method further comprises moving a movable gantry press to the location of the first die assembly, and moving a first robot to the location of the first die assembly. The method further comprises causing, by the controller, the first robot to load a first blank into the first die assembly, causing, by the controller, the movable gantry press to operate the first die assembly to fabricate the first finished part.

In accordance with an embodiment and any of the preceding embodiments, moving the movable gantry press to the location of the first die assembly further comprises causing the movable gantry press to traverse a press rail system to access the first die assembly.

In accordance with an embodiment and any of the preceding embodiments, moving the first robot to the location of the first die assembly further comprises causing the first robot to traverse a robot rail system to access the first die assembly.

In accordance with an embodiment and any of the preceding embodiments, the method further comprises moving a second robot to the location of the first die assembly, and after causing the movable gantry press to operate the first die assembly to fabricate the first finished part, causing the second robot to remove the first finished part from the first die assembly.

In accordance with an embodiment and any of the preceding embodiments, the method further comprises receiving, at the controller, a second input to fabricate a second finished part, and identifying, by the controller, a second die assembly of the plurality of die assemblies. The method further comprises moving the movable gantry press to the location of the second die assembly, and moving the first robot to the location of the second die assembly. The method further comprises causing the first robot to load a second blank into the second die assembly, and causing the movable gantry press to operate the second die assembly to fabricate the second finished part.

In accordance with an embodiment and any of the preceding embodiments, the first finished part has a first shape and the second finished part has a second shape different from the first shape.

In accordance with an embodiment and any of the preceding embodiments, each die assembly comprises an upper die section and a lower die section. Causing the movable gantry press to operate the first die assembly to fabricate the first finished part further comprises lifting the upper die section of the first die assembly, after the first robot has loaded the first blank into the first die assembly, lowering the upper die section of the first die assembly, and actuating an actuator of the movable gantry press to compress the first blank between the upper die section and the lower die section of the first die assembly to fabricate the first finished part.

In accordance with an embodiment and any of the preceding embodiments, the method further comprises for each die assembly, heating at least one of an upper die section or a lower die section of the die assembly to at least a predetermined temperature.

In accordance with an embodiment and any of the preceding embodiments, the predetermined temperature is at least about 900 degrees F.

DETAILED DESCRIPTION

Embodiments described herein relate to forming finished parts, and more particularly to forming finished parts using a movable gantry press and a plurality of die assemblies, and related systems, devices, and methods.

Figure 1:
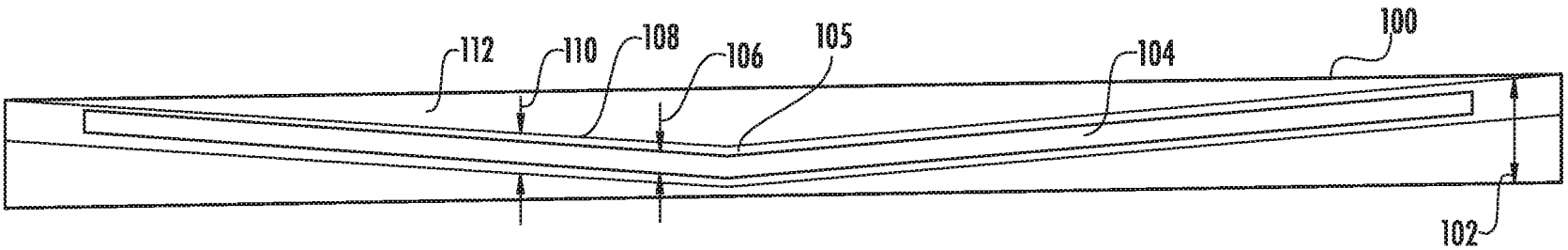
FIG. 1 is a cross-sectional view comparing a blank for forming a finished part according to an embodiment with a conventional blank for forming the finished part.

In this regard, FIG. 1 is a cross-sectional view comparing a blank 108 for forming a finished part 104 according to an embodiment with a conventional blank 100 for forming the finished part. The conventional blank 100 has a first thickness 102 for forming the finished part 104, e.g., a splice plate for an aircraft in this example. In this embodiment, the conventional blank 100 is made of a metal, metal alloy, or other material. To form the finished part 104 having a desired shape 105 and thickness 106, the conventional blank 100 is typically milled (e.g., with a computer numerical control (CNC) machine) to remove excess material 112, which may be discarded as waste or recycled. According to embodiments herein, the finished part 104 may be formed using a blank 108 having a second thickness 110 that is significantly smaller than the first thickness 102 of the conventional blank 100. Rather than machining a larger conventional blank 100, the thinner blank 108 may be compressed in a heated die assembly using a gantry press (See FIGS. 2A and 2B) to deform the blank 108 into the finished part 104 having the desired shape 105 and thickness 106. In this example, the blank 108 is a titanium blank and the finished part 104 is a part for an aircraft, which can result in substantial material savings and machine time savings per finished part 104 over conventional processes that employ larger conventional blanks 100.

Using a gantry press and heated die assembly becomes difficult, however, as the size of the finished part 104 increases. For example, conventional die assemblies may be unsuitable for forming large aircraft parts such as the finished part 104, which may have large sizes and complex shapes and profiles. By using the embodiments described herein, however, large parts with complex profiles, such as the finished part 104, may be formed using a gantry press and heated die assemblies, which allows much smaller and thinner blanks 108 to be used. Additional benefits include significant cost savings, a significantly larger ratio of material in the finished part, less milling time, lower total raw material costs, less waste. Reducing milling time also significantly decreases manufacturing flow times, CNC loads, labor requirements, and consumption of perishable tools. Many of the embodiments described herein may be partially or fully automated, resulting in a reduction in worker injuries and worker stress, and an increase in worker productivity.

Figure 2A:
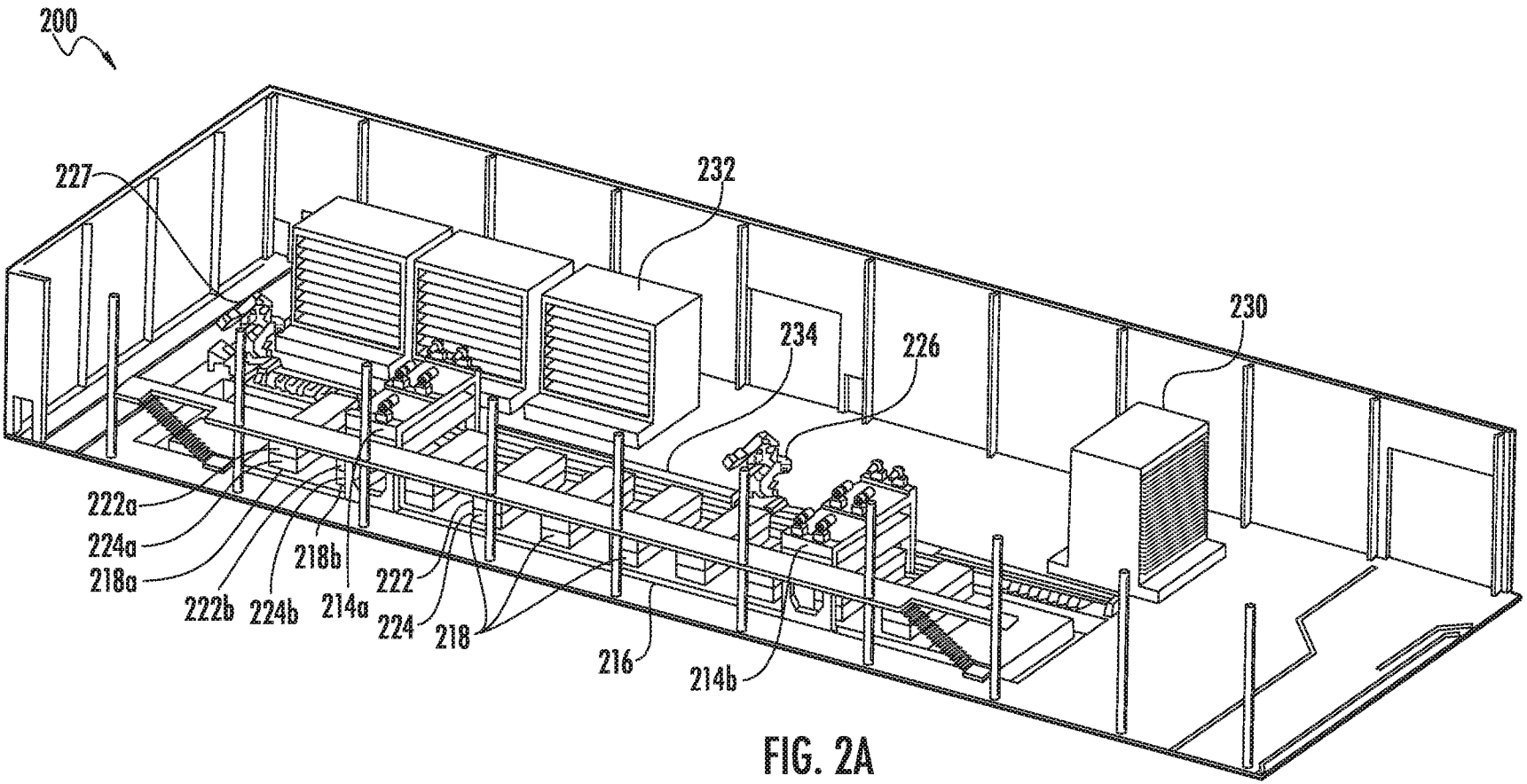
FIGS. 2A and 2B are respective perspective and schematic views of a system for forming finished parts using a movable gantry press and a plurality of die assemblies, according to an embodiment.
Figure 2B:
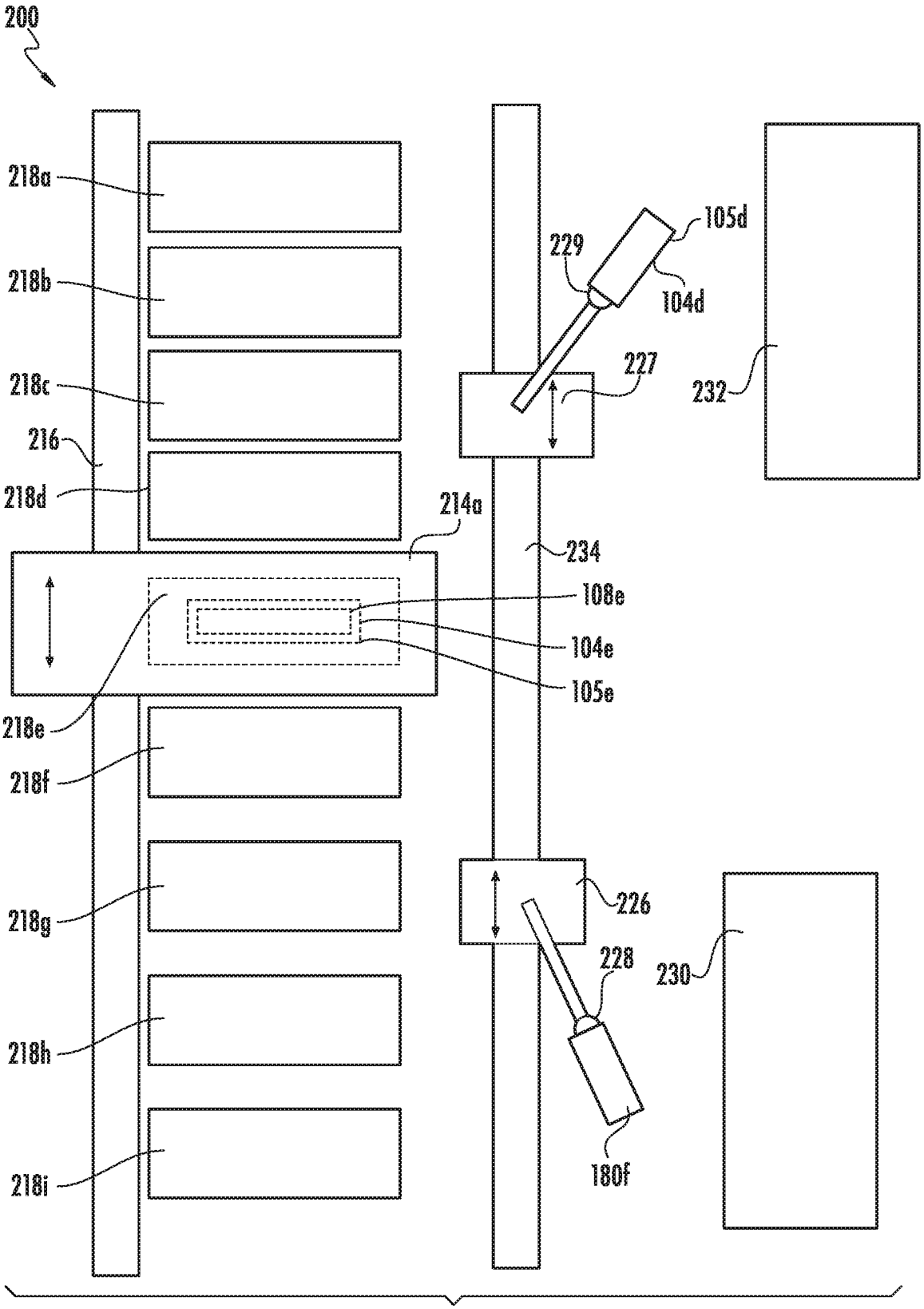

Referring now to FIGS. 2A and 2B, schematic views of a system 200 for forming finished parts using a movable gantry press and a plurality of stationary die assemblies are illustrated, according to an embodiment. As used herein, the term stationary does not mean that the die assemblies 218 are not movable, rather stationary means that the die assemblies 218 are maintained at a predetermined location during the fabrication of the finished parts 104 and the gantry press 214 is configured to move to the predetermined location of the die assemblies 218 rather than the die assemblies 218 being transported to the location of the gantry press as is done in some known systems. It should therefore be realized that the die assemblies 218 may be placed at any desired position to optimize the fabrication of the various finished parts 104. In this example, the system 200 is configured to form titanium parts for large commercial aircraft, but it should be understood that these and other embodiments may be used with a wide variety of materials and for a wide variety of applications. The system 200 includes at least one movable gantry press 214 that is selectively movable along a press rail system 216 between a plurality of self heating die assemblies 218*a*-218*i* (see FIG. 2B). The self-heating features of the die assemblies 218 are discussed in greater detail below with respect to FIGS. 5A and 5B. In this example, the system 200 includes multiple movable gantry presses 214*a*, 214*b*, which may independently move between different die assemblies 218 and operate multiple die assemblies 218 simultaneously, thereby increasing efficiency and utilization of the system 200. In this example, each movable gantry press 214 is a dual gantry 580-ton electric ballscrew press. An electric press has the advantage of being more mobile than a conventional hydraulic press, which generally use hydraulic supply and are typically designed to be stationary.

Because the die assemblies 218 are extremely large and heavy in comparison to conventional die assemblies, the die assemblies 218 are configured to be stationary and the movable gantry press 214 moves between the different die assemblies 218. The different die assemblies 218 may be configured to form different parts, or the same part, as desired. Another advantage of using multiple stationary die assemblies 218 is that each die assembly can be continuously heated, which reduces temperature-based wear and damage on the die assemblies 218 resulting from heating, cooling, and re-heating, which may reduce the service life of the die assemblies 218. This heating, cooling, and re-heating process can also be time-consuming, due to the large size and mass of the die assemblies 218. By keeping the die assemblies 218 continuously heated, the die assemblies 218 may be constantly available for use, without the need for a lengthy heat-up or cool-down period before or after using the die assembly 218.

Moreover, because the movable gantry press 214 is not required to be permanently or continuously coupled to any of the die assemblies 218, the die assemblies 218 can be maintained at extremely high temperatures without subjecting the movable gantry press 214 to these temperatures for extended periods of time. For example, in this embodiment, components of the die assemblies 218, and particularly the upper and lower segmented dies of the die assemblies 218 (described in greater detail with respect to FIGS. 3A-5B below), are configured to be continuously heated at temperatures of at least 900 degrees F., and specifically in the range of 900 to 1350 degrees F., which is a desirable temperature range for hot-forming titanium parts, which are widely used in aircraft applications. By moving the movable gantry press 214 between the different die assemblies 218 and removably coupling the movable gantry press 214 to a particular die assembly 218 during use of the die assembly 218, the die assemblies 218 can be maintained in a continuously heated state at stationary positions without causing unnecessary temperature-based wear and damage to the movable gantry press 214.

An upper platen (not shown) of the movable gantry press 214 is configured to, for each die assembly 218, releasably couple to the upper die section of the die assembly 218 and an actuator (not shown) of the movable gantry press 214 is configured to, for each die assembly 218, selectively compress a blank 108 between the upper die section and the lower die section of the die assembly to deform the blank into a finished part 104 comprising a desired shape.

As best shown in FIG. 2B, robots 226, 227 are used to move the blanks 108 and finished parts 104 into and out of the die assemblies 218. One example of a suitable robot is a 6-axis long arm robot, but it should be understood that different robots may be used, as desired. In this example, a first robot 226 uses a first end effector 228 to retrieve the blank 108 from a raw material rack 230 and place the blank 108 between the upper die section 222 and the lower die section 224 (see FIGS. 3A-3F) of the die assembly 218. After the finished part 104 has been formed, a second robot 227 uses a second end effector 229 configured to remove the finished part 104 from between the upper die section 222 and the lower die section 224 of the die assembly 218 and place the finished part 104 on a cooling rack 232 to cool. In this example, the robots 226, 227 are movable along a robot rail system 234. It should be understood that any number of robots may be used, with each robot including one or more end effectors for transporting the blanks 108, finished parts 104, or both. In the embodiment of FIGS. 2A and 2B, the first robot 226 and second robot 227 have different functions and can move independently of each other, allowing the first robot 226 to begin carrying and loading a blank into one die assembly 218 while the second robot simultaneously finished removing a finished part from another die assembly 218, thereby increasing system efficiency. In another embodiment, a single robot includes a single end effector that performs the functions of both the first end effector 228 and the second end effector 229, i.e., transporting both the blanks 108 and the finished parts 104. In another embodiment, the first robot includes the first end effector 228 configured to handle the room-temperature blanks 108 and the second end effector 229 configured to handle the higher-temperature finished parts 104.

In the view shown by FIG. 2B, operation of the movable gantry press 214*a* is illustrated. For simplicity, movable gantry press 214*b* is not shown, but in this embodiment, both movable gantry presses 214 operate interchangeably with the plurality of die assemblies 218, so that multiple die assemblies 218 can be used simultaneously. In the view shown by FIG. 2B, the second robot 227 is transporting a finished part 104*d* (having a desired shape 105*d*) from the previously used die assembly 218*d* to the cooling rack 232. The movable gantry press 214*a* is operating die assembly 218*e* to compress a blank (not shown), which was previously loaded into the into the die assembly 218*e* by the first robot 226, to form the finished part 104*e*. When the finished part 104*e* has been formed, the second robot 227 will remove the finished part 104*e* from the die assembly 218*e* and transport the finished part 104*e* to the cooling rack 232. Meanwhile, the first robot 226 in this view is transporting the next blank 108*f* to be loaded into the an adjacent die assembly 218*f* after the gantry press 214*a* has moved from the die assembly 218*e* to the adjacent die assembly 218*f*. After the next blank 104*f* is loaded into the die assembly 218*f*, the gantry press 214*a* will operate the die assembly 218*f* to compress the blank 108*f* into a finished part (not shown), and so on.

In this example, the different die assemblies 218 produce different finished parts 104 having different shapes 105. For example, the shape 105*d* of the finished part 104*d* formed using the die assembly 218*d* is different than the shape 105*e* of the finished part 104*e* formed using the die assembly 218*e*. This has the advantage of increasing efficiency and utilization of the system 200 so that different finished parts 104 can be produced simultaneously and at different rates, as desired. In an alternate embodiment, the die assemblies 218 all produce the same finished parts 104 having the same shapes 105, which has the advantage of increasing output volume and speed for the system 200.

Figure 3A:
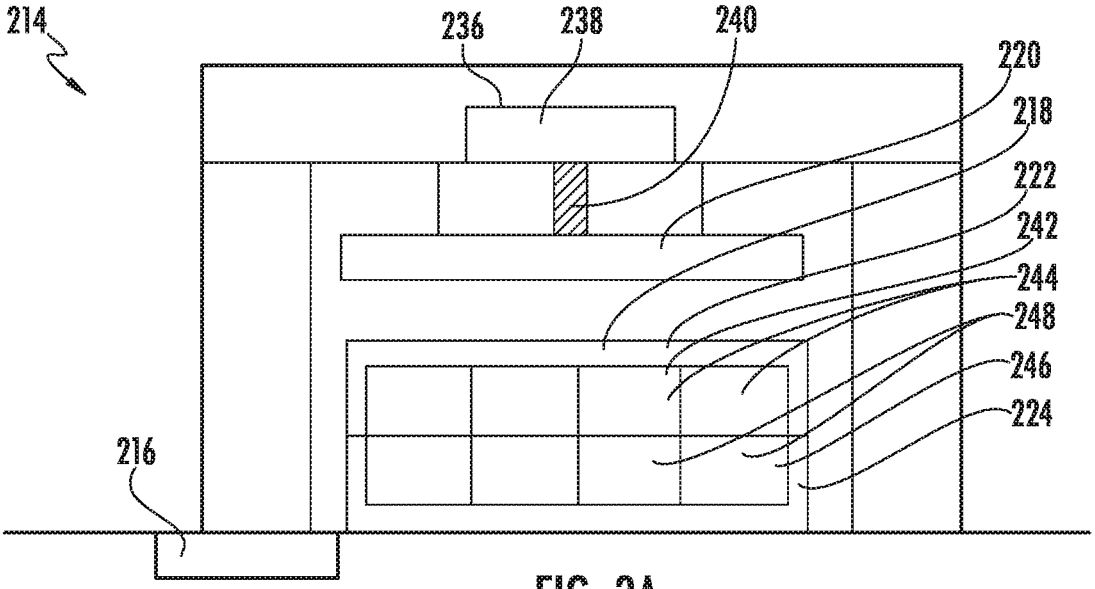
FIGS. 3A-3F are simplified schematic views illustrating operation of the movable gantry press of the system of FIGS. 2A and 2B.
Figure 3B:
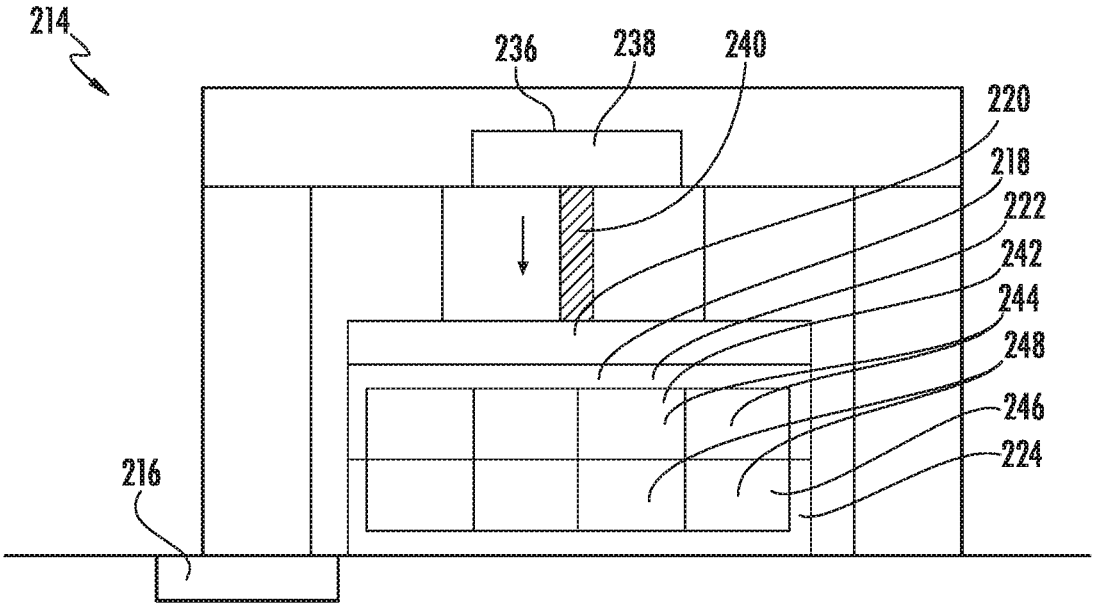
Figure 3C:
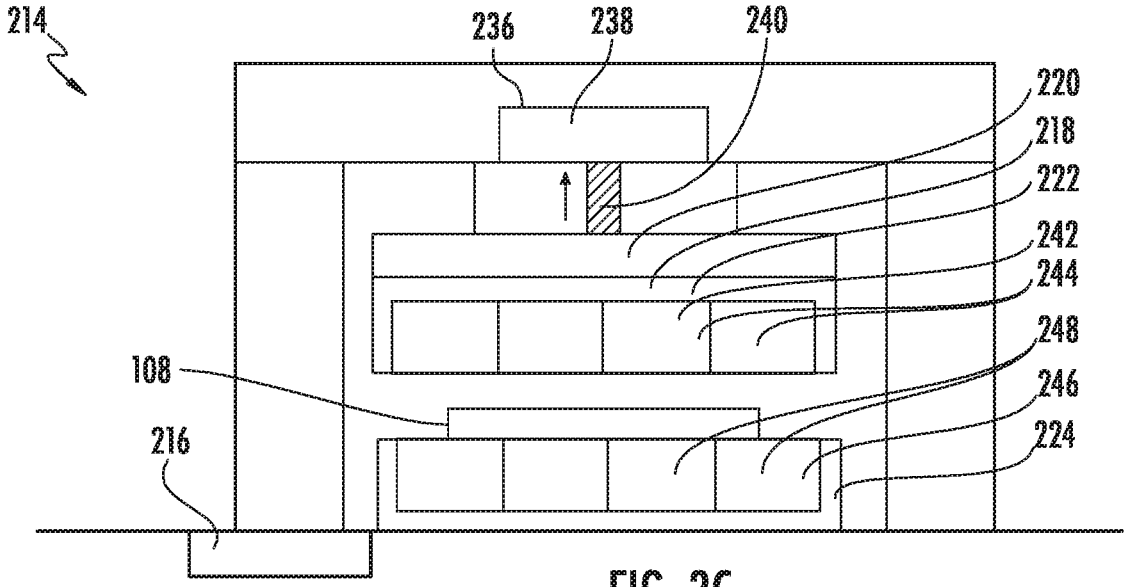

As noted above, using a movable gantry press 214 and heated die assembly 218 to form larger parts presents special challenges, such as forming suitably large dies for forming these larger parts. To address this problem, the die assembly 218 includes a segmented die formed from a linear array of die segments. In this regard, FIGS. 3A-3F are simplified schematic views illustrating operation of system 200 using the movable gantry press 214 of FIGS. 2A and 2B, to form finished parts using one of the segmented die assemblies 218, according to an embodiment. FIG. 3A illustrates one of the movable gantry presses 214 being positioned along a press rail system 216 above a heated die assembly 218. In FIG. 3B, an upper platen 220 of the movable gantry press 214 is lowered onto the upper die section 222 of the die assembly 218 and is releasably coupled to the upper die section 222. In FIG. 3C, the upper platen 220 is raised, lifting the upper die section 222 away from the lower die section 224, and a blank 108 is placed on the lower die section 224 under the upper die section 222.

Figure 3D:
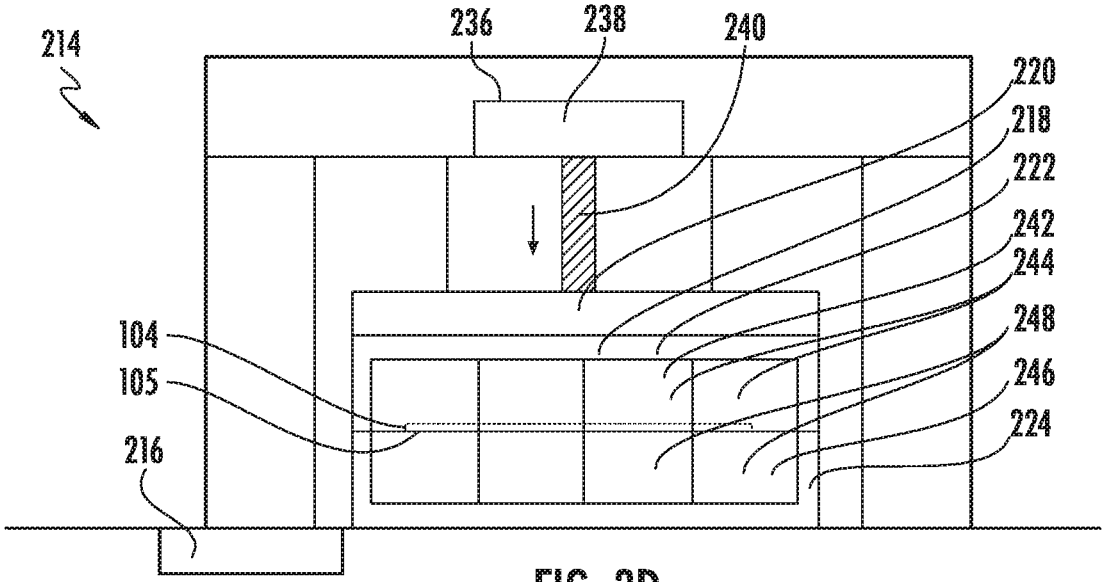
Figure 3E:
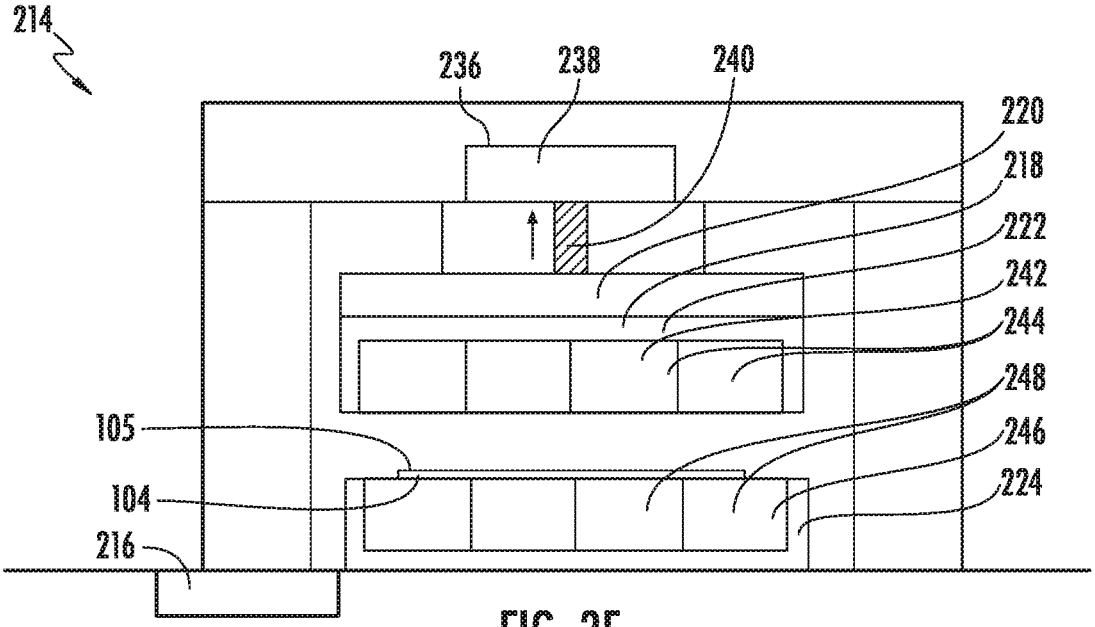
Figure 3F:
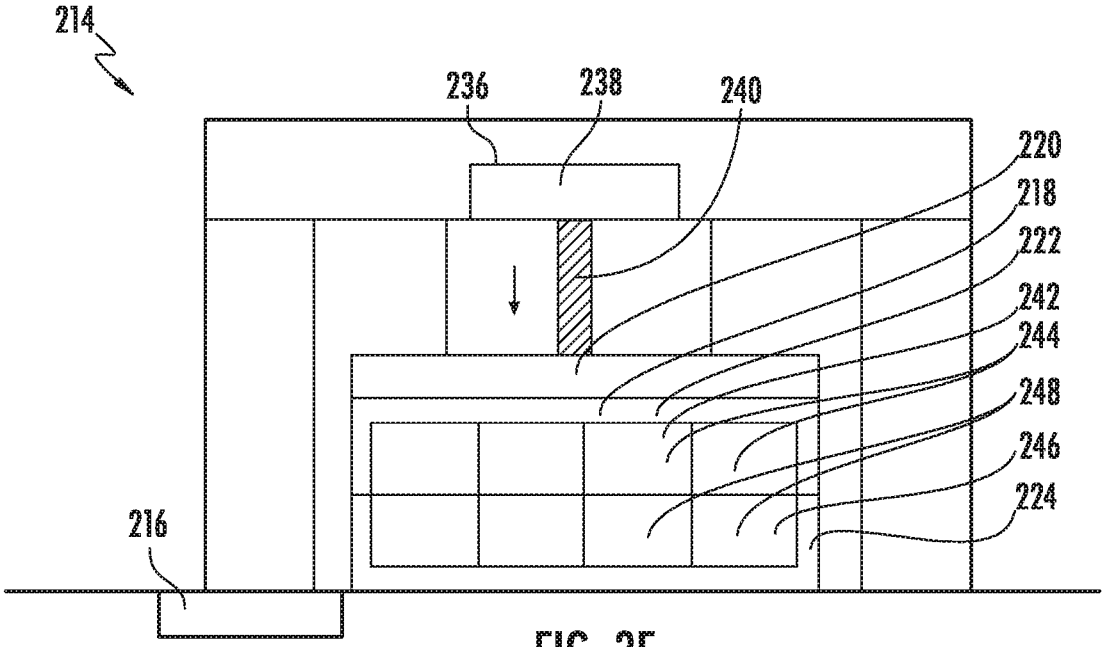

In FIG. 3D, the upper platen 220 is lowered, and an actuator 236 applies downward force to the upper die section 222 to compress and deform the blank 108 between the heated upper die section 222 and lower die section 224 to form the finished part 104 having a desired shape 105. In this example, the actuator 236 includes an electric motor 238 that drives a ballscrew 240 (also referred to as a roller screw) to apply the downward force on the upper die section 222. As discussed above, using an electric motor 238 has some advantages over conventional hydraulic press components, such as greater mobility, greater heat resistance, and increased efficiency and reliability as the sizes of the components increase. In FIG. 3E, the upper platen 220 lifts the upper die section 222 away from the lower die section 224 to allow the finished part 104 to be removed from the die assembly 218. In FIG. 3F, the upper platen 220 then lowers the upper die section 222 onto the lower die section 224 and decouples from the upper die section 222 so that the movable gantry press 214 can traverse along the press rail system 216 to another die assembly 218.

As will be discussed in greater detail below with respect to FIG. 5A, the upper die section 222 includes an upper segmented die 242 (which may also be referred to as a punch block) having a plurality of upper die segments 244 coupled to each other in a linear array. Similarly, the lower die section 224 includes a lower segmented die 246 (which may also be referred to as a die block) having a plurality of lower die segments 248 coupled to each other in a linear array. As the actuator 236 applies force to the upper die section 222, the upper die segments 244 act together to press toward the lower die segments 248, which also act together to compress the blank 108 therebetween to form the finished part 104.

Figure 4A:
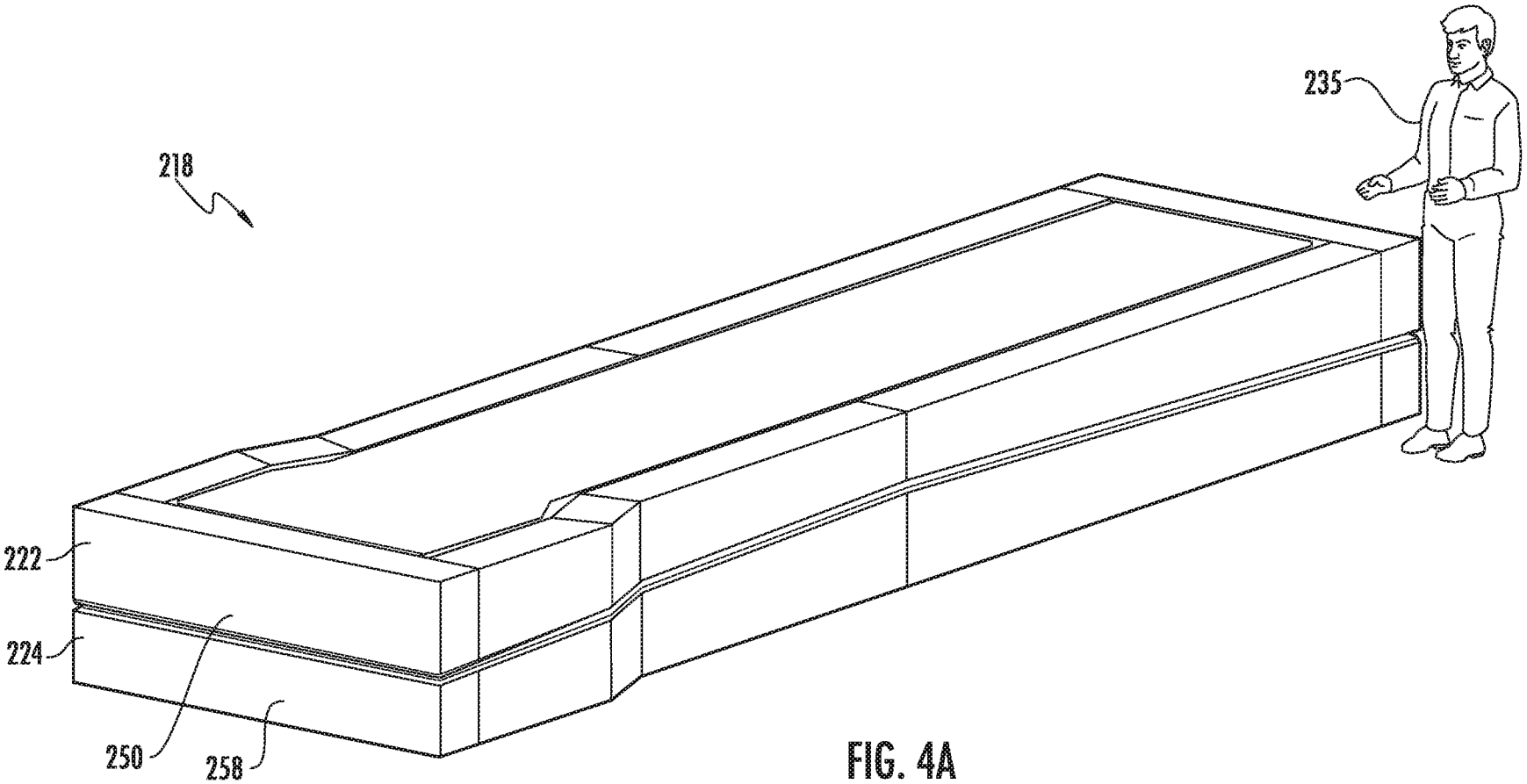
FIG. 4A is a perspective view of perspective views of components of a die assembly of the system of FIGS. 2A and 2B.
Figure 4B:
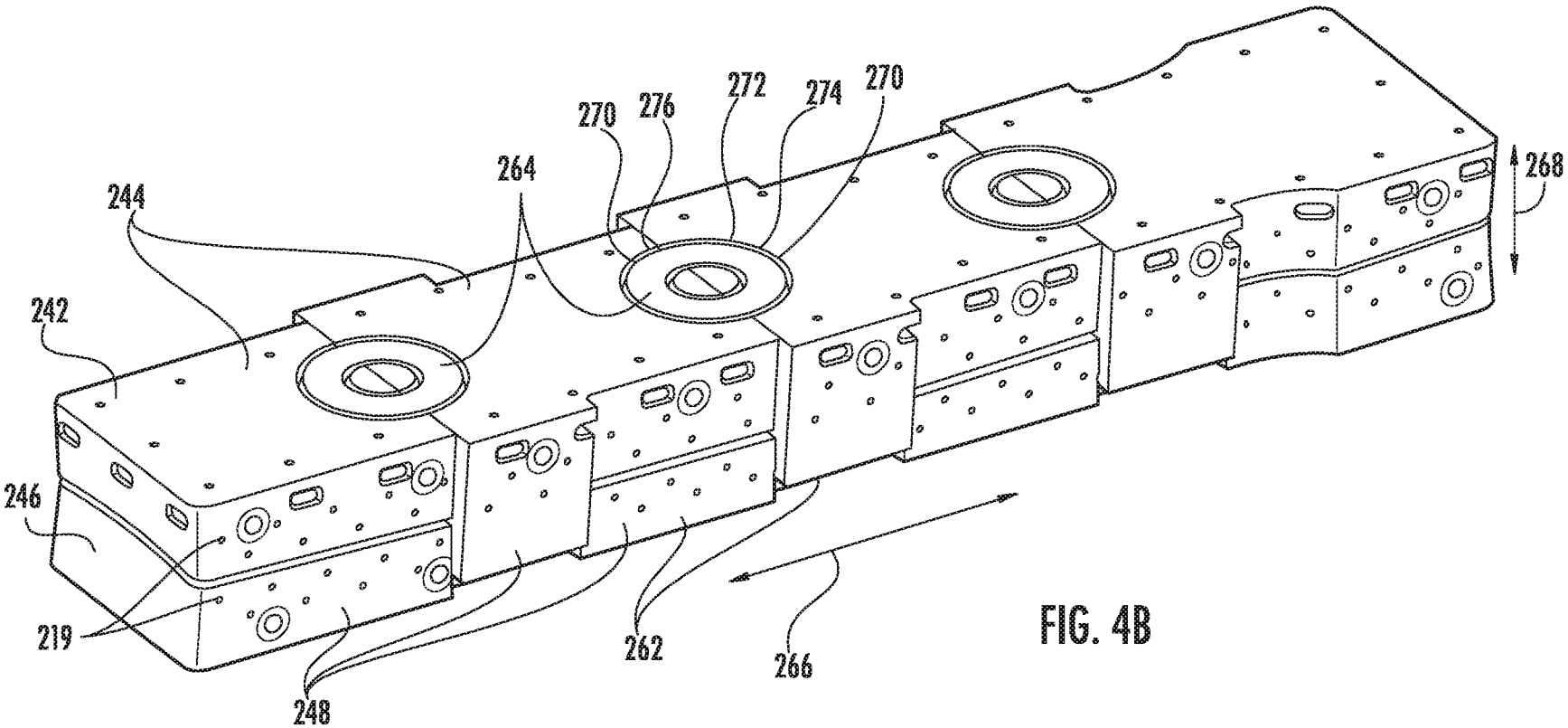
FIG. 4B is a perspective view of perspective views of components of the die assembly of FIG. 4A, with the upper and lower insulation subassemblies removed.

Referring now to FIGS. 4A and 4B, perspective views of components of a die assembly 218 of the system 200 of FIGS. 2A and 2B are illustrated. For large applications, each die assembly 218 can weigh in excess of 20,000 pounds. For example, as shown in FIG. 4A, the die assembly 218 of this embodiment for forming large aircraft parts, shown with a human 235 for scale, is more than 25 inches thick, more than 250 inches long, and weighs over 35,000 pounds. The upper die section 222 includes an upper segmented die 242 (e.g., punch block) housed within an upper insulation subassembly 250, and the lower die section 224 includes a lower segmented die 246 (e.g., die block) housed within a lower insulation subassembly 258.

Referring now to FIG. 4B, the upper segmented die 242 and the lower segmented die 246 are illustrated with the upper insulation subassembly 250 and lower insulation subassembly 258 of FIG. 4A removed. The upper segmented die 242 includes a plurality of upper die segments 244 and the lower segmented die 246 includes a plurality of lower die segments 248, arranged in a linear array 262. The upper die segments 244 are removably coupled to each other by a plurality of coupling structures 264. The lower die segments 248 are removably coupled to each other by a plurality of coupling structures (not shown). In this example, each coupling structure 264 comprises a pair of grooves 270 that form a ring-shaped recess 276 when adjacent upper die segments 244 are arranged in the linear array 262. The ring-shaped recess 276 receives a complementary retainer structure 272, which is a ring-shaped element 274 in this example. The ring-shaped element 274 is removably inserted into the ring-shaped recess 276 in a transverse direction 268 substantially perpendicular to the longitudinal direction 266 of the linear array 262 and prevents movement of the upper die segments 244 with respect to each other in the longitudinal direction 266. Each upper and lower die segment 244, 248 further includes a plurality of heating element recesses 219 for receiving and housing a plurality of heating elements (not shown), for heating the upper segmented die 242 and lower segmented die 246 to a desired temperature range.

Figure 5A:
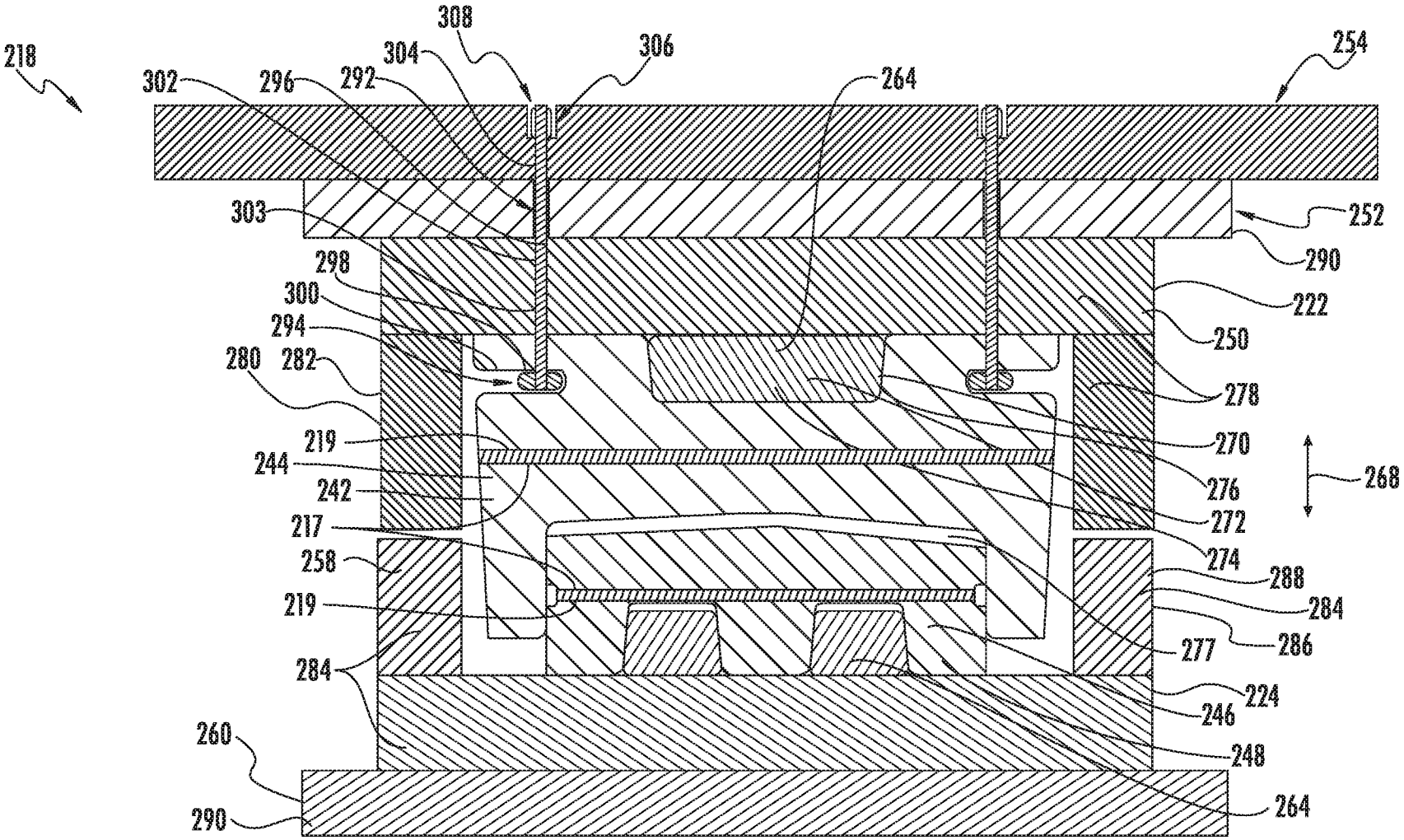
FIGS. 5A and 5B are cross-sectional views components of the system of FIGS. 2A and 2B.
Figure 5B:
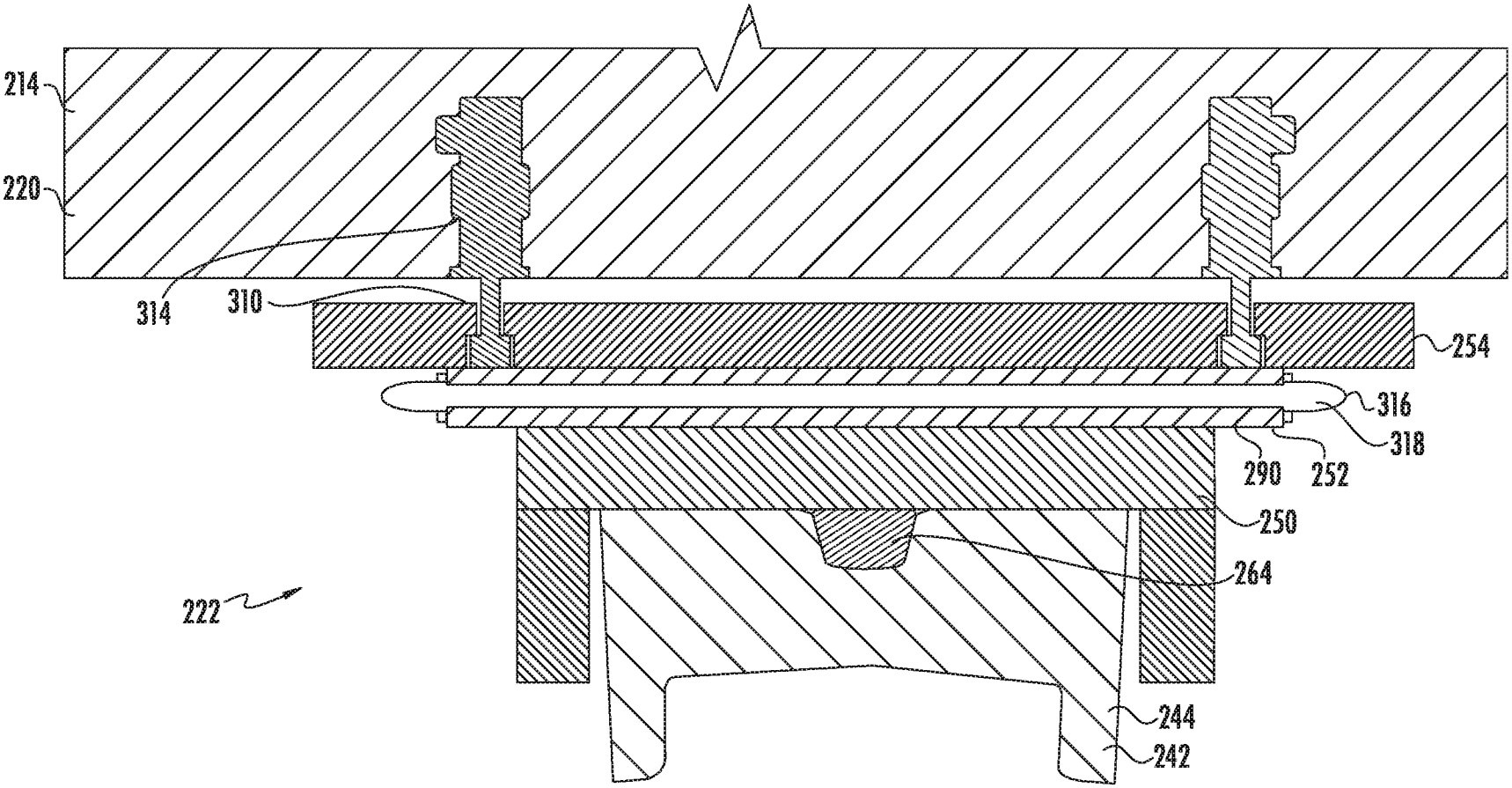

Referring now to FIGS. 5A and 5B, more detailed cross-sectional views of components of the systems 200 of FIGS. 2A-4B are illustrated. The die assembly 218 includes an upper die section 222 and a lower die section 224. The upper die section 222 includes an upper segmented die 242 and an upper insulation subassembly 250 configured to provide insulation for the heated upper die segments 244 of the upper segmented die 242. The upper die section 222 includes an upper cooling subassembly 252 configured to cool excess heat from the upper insulation subassembly 250, and a transfer plate 254 configured to be removably coupled to an upper platen 220 of a movable gantry press 214 (see FIG. 5B). The lower die section 224 includes a lower segmented die 246, a lower insulation subassembly 258, and a lower cooling subassembly 260.

As shown by FIG. 5A, the upper segmented die 242 includes a plurality of upper die segments 244 coupled to each other via a plurality of coupling structures 264. In this example, each coupling structure 264 comprises a retainer structure 272 forming a ring-shaped element 274 that is received in complementary grooves 270 forming a ring-shaped recess 276. The lower segmented die 246 includes a plurality of lower die segments 248 coupled to each other via another plurality of coupling structures 264. Each upper and lower die segment 244, 248 includes a plurality of heating element recesses 219 for receiving and housing a plurality of heating elements 217.

The upper insulation subassembly 250 and lower insulation subassembly 258 include a respective upper insulation material 278 and lower insulation material 284 that substantially enclose the upper segmented die 242 and lower segmented die 246 when the die assembly 218 is in a closed configuration, i.e., with the upper segmented die 242 and lower segmented die 246 closed around a mold cavity 277. In general, the upper segmented die 242 and lower segmented die 246 will be opened only to place a blank or remove a finished part from the mold cavity 277. By substantially enclosing the upper segmented die 242 and lower segmented die 246 when in the closed configuration, the upper segmented die 242 and lower segmented die 246 can retain heat for longer periods, thereby requiring less energy to keep the upper segmented die 242 and lower segmented die 246 heated.

To protect the upper insulation material 278 and lower insulation material 284, an upper cladding material 280 is disposed on an outer surface 282 of the upper insulation material 278, and a lower cladding material 286 is disposed on an outer surface 288 of the lower insulation material 284.

In this example, the upper cooling subassembly 252 and the lower cooling subassembly 260 each include a chill plate 290 to protect the respective transfer plate and support surface (e.g., a facility floor or platform) from temperature-based wear and damage. The chill plates 290 can also be used to selectively regulate the temperature of the upper segmented die 242 and lower segmented die 246, as desired. As shown by FIG. 5B, each chill plate 290 includes exposed tubing 316 for holding and transporting a cooling fluid 318 therethrough.

In this example, the upper die section 222 is coupled together via a plurality of fastener assemblies 292. In this example, each fastener assembly 292 includes a hanger pad 294 that is disposed in a hanger pad recess 298. Each hanger pad recess 298 includes a slot 300 that is substantially coplanar with the longitudinal direction (not shown) and a hole 302 extending in the transverse direction 268 substantially orthogonal to the longitudinal direction and the slot 300. A hanger rod 296 extends through the hole 302 and is coupled to the hanger pad 294 through a first portion 303 of the hole 302 extends through one of the upper die segments 244 and a second portion 304 of the hole 302 extends through the upper insulation subassembly 250, the upper cooling subassembly 252, and the transfer plate 254. A washer stackup 306 and threaded retaining nut 308 at the top end of the hanger rod 296 prevents movement of the components of the upper die section 222 with respect to each other in the transverse direction 268 and allows the transfer plate 254 to lift the entire upper die section 222. In this manner, the transfer plate 254 and upper insulation subassembly 250 is releasably coupled to the upper segmented die 242.

FIG. 5B illustrates the upper platen 220 of the movable gantry press 214 removably coupled to the transfer plate 254 of the upper die section 222. A plurality of clamping elements 314 of the upper platen 220 engage a plurality of respective attachment points 310 of the transfer plate 254 to removably couple the transfer plate 254 to the upper platen 220, thereby allowing the movable gantry press 214 to selectively raise and lower the upper die section 222.

Figure 6A:
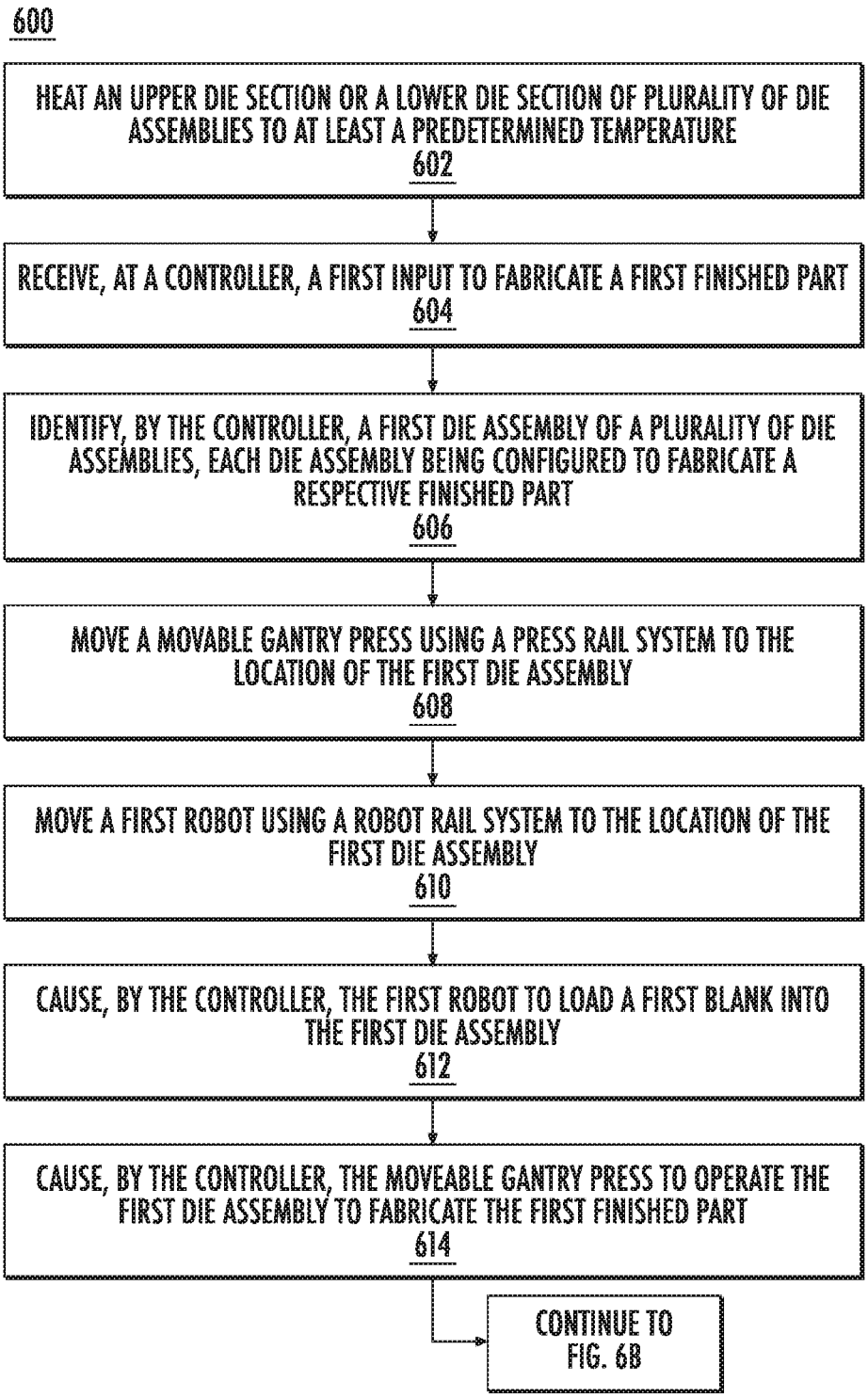
FIGS. 6A-6D are flowcharts of an example of a method for forming a finished part using the system of FIGS. 2A and 2B.

Referring now to FIGS. 6A-6D flowcharts of an example of a method 600 for forming a finished part are illustrated, according to an embodiment. In this example, the method 600 uses components of the system 200 of FIGS. 2A-2B, described above. In FIG. 6A, the method 600 includes heating an upper die section or a lower die section of a plurality of die assemblies 218 to at least a predetermined temperature (Block 602). The method 600 further includes receiving, at a controller 702 (see FIG. 7 below), a first input to fabricate a first finished part 104 (Block 604). The method 600 further includes identifying, by the controller, a first die assembly 218 of a plurality of die assemblies 218, each die assembly 218 being configured to fabricate a respective finished part 104 (Block 606). The method 600 further includes moving a movable gantry press 214, i.e., causing the movable gantry press 214 to traverse a press rail system 216, to the location of the first die assembly 218 (Block 608) and moving a first robot 226, i.e., causing the first robot 226 to traverse a robot rail system 234, to the location of the first die assembly 218 (Block 610). The method 600 further includes causing, by the controller 702, the first robot 226 to load a first blank 108 into the first die assembly 218 (Block 612), and causing, by the controller 702, the movable gantry press 214 to operate the first die assembly 218 to fabricate the first finished part 104 (Block 614).

Figure 6B:
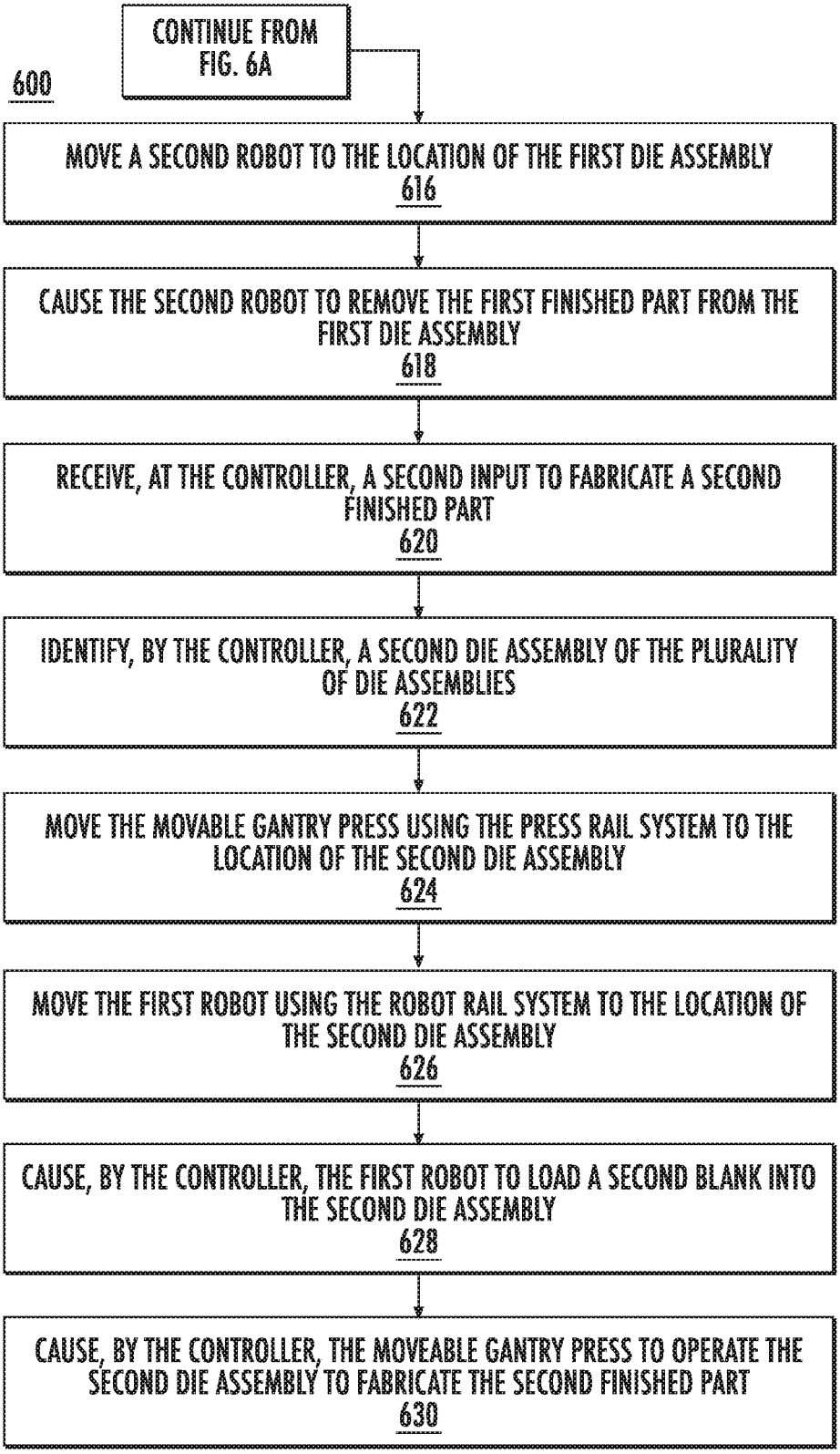

Continuing to FIG. 6B, the method 600 further includes moving a second robot 227 to the location of the first die assembly 218 (Block 616) and causing the second robot 227 to remove the first finished part 104 from the first die assembly 218 (Block 618). The method 600 further includes receiving, at the controller 702, a second input to fabricate a second finished part 104 (Block 620), and Identify, by the controller 702, a second die assembly 218 of the plurality of die assemblies 218 (Block 622). The method 600 further includes moving the movable gantry press 214 using the press rail system 216 to the location of the second die assembly 218 (Block 624), and moving the first robot 226 using the robot rail system 234 to the location of the second die assembly 218 (Block 626). The method 600 further includes causing, by the controller 702, the first robot 226 to load a second blank 108 into the second die assembly 218 (Block 628), and causing, by the controller 702, the movable gantry press 214 to operate the second die assembly 218 to fabricate the second finished part 104 (Block 630).

Figure 6C:
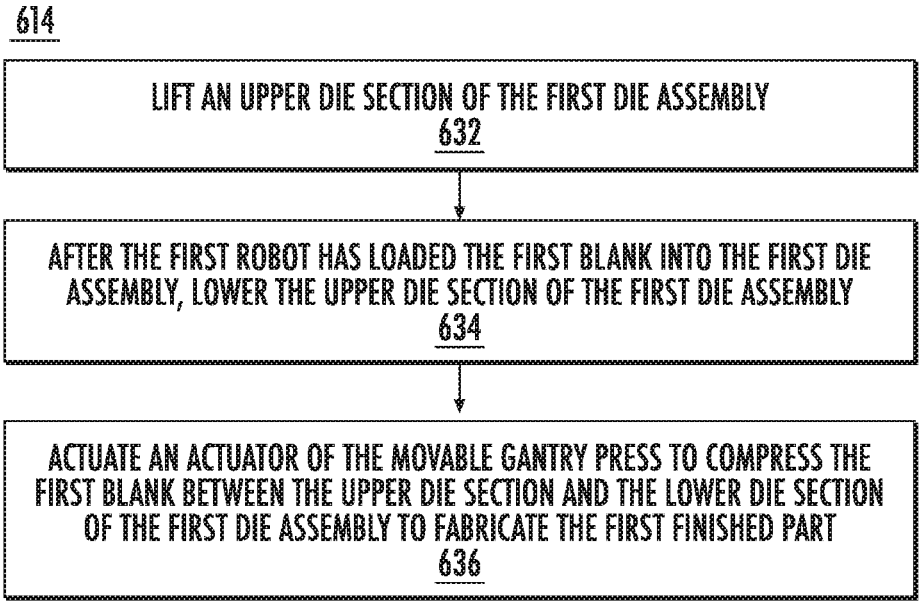

As shown by FIG. 6C, causing the movable gantry press 214 to operate the first die assembly 218 to fabricate the first finished part 104 (Block 614) further includes, in response to being instructed to operate the first die assembly (i.e., by the controller 702 of FIG. 7), lifting an upper die section 222 of the first die assembly (Block 632), and, after the first robot 226 has loaded the first blank 108 into the first die assembly 218, lowering the upper die section 224 of the first die assembly 218 (Block 634). Next, an actuator 236 (See FIGS. 3A-3F) of the movable gantry press 214 is actuated to compress the first blank 108 between the upper die section 222 and a lower die section 224 of the first die assembly 218 to fabricate the first finished part 104 (Block 636).

Figure 6D:
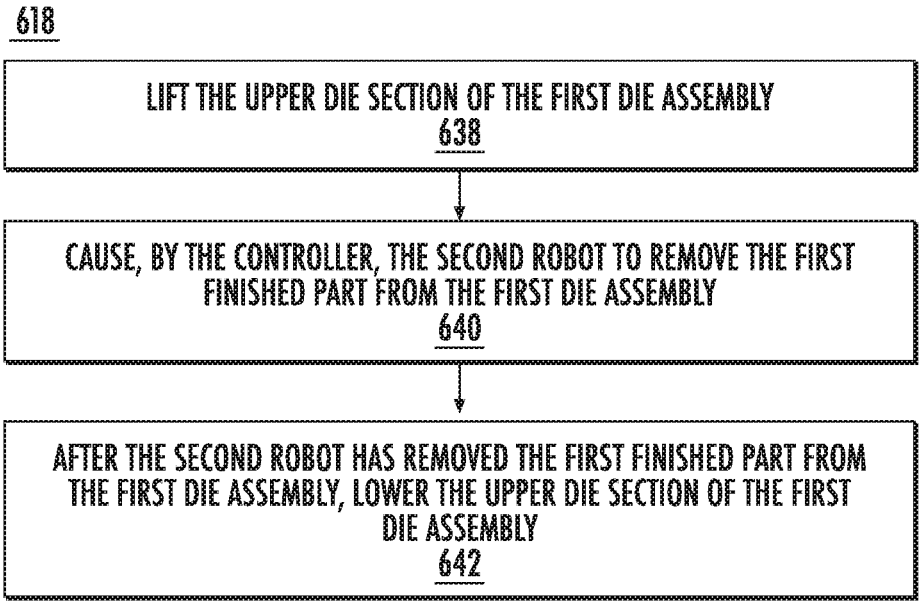

As shown by FIG. 6D, causing the second robot 227 to remove the first finished part 104 from the first die assembly 218 (Block 618) further comprises lifting the upper die section 222 of the first die assembly 218 (Block 638), causing, by the controller 702, the second robot 227 to remove the first finished part 104 from the first die assembly 218 (Block 640), and, after the second robot 227 has removed the first finished part 104 from the first die assembly 218, lower the upper die section 222 of the first die assembly 218 (Block 642).

These and other operations are performed by a controller or other computing device or system configured to operate the gantry press, robots or other machinery in the systems and devices described herein. For example, in this embodiment, a controller 702 (See FIG. 7) is configured to selectively move the movable gantry press between the plurality of die assemblies and selectively actuate the actuator to compress the blank into the finished part. The controller 702 is also configured to operate the robot(s) to move the blank and finished part into and out of the die assembly.

Figure 7:
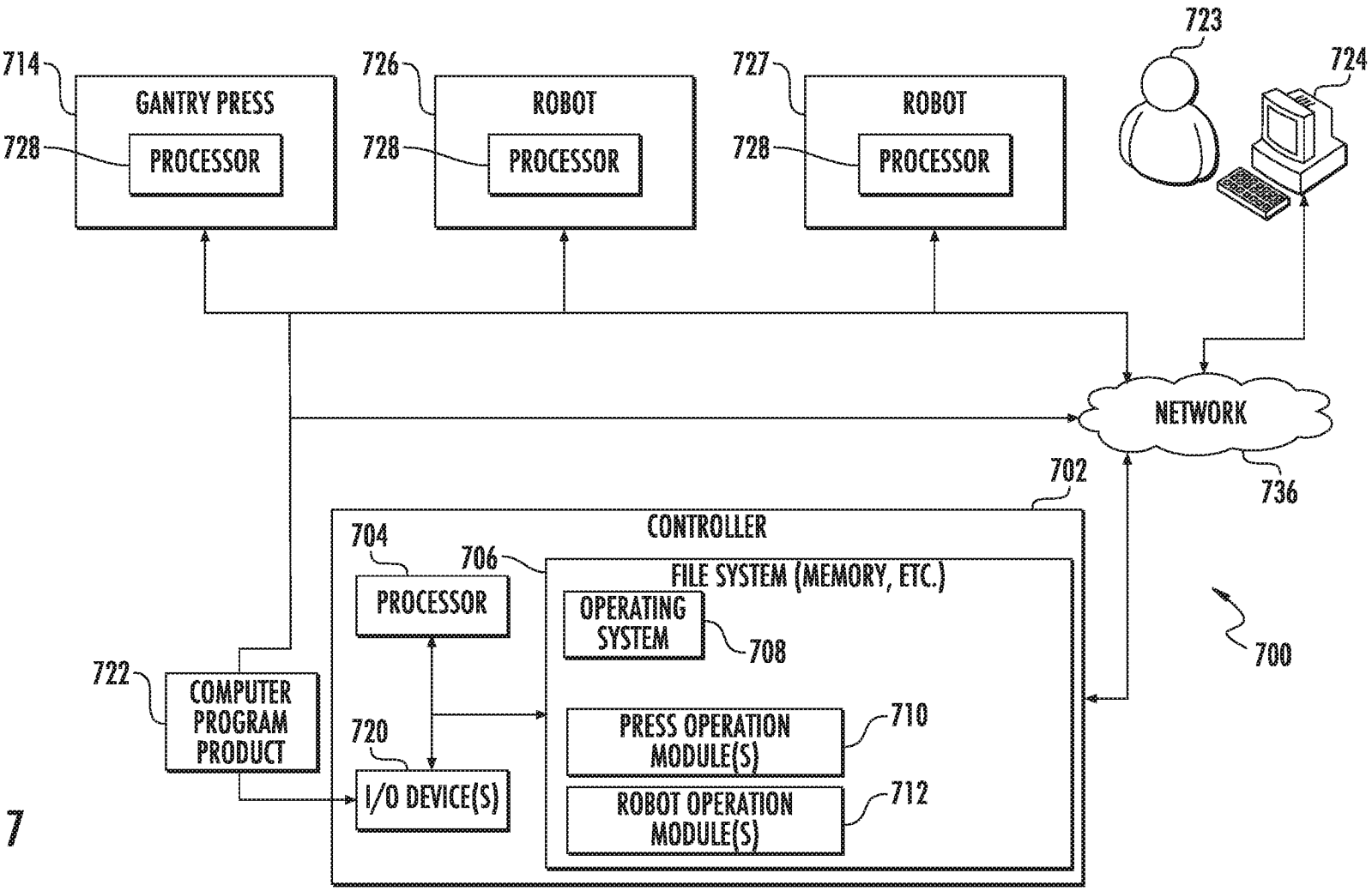
FIG. 7 is a block schematic diagram of a computing system for carrying out operations of the systems, devices, or methods disclosed herein, including the system of FIGS. 2A and 2B.

In this regard, FIG. 7 is a block schematic diagram of a computing system 700 for carrying out operations of any of the systems, devices, or methods disclosed herein, according to an embodiment. In accordance with an embodiment, the method 600 of FIGS. 6A-6D is embodied in and performed by the computing system 700 and aspects of the embodiments described herein are performed, generated and presented by the computing system 700. The computing system 700 includes a controller 702 for controlling various system components, such as the movable gantry press 214 and robots 226, 727. In accordance with the example of FIG. 7, the controller 702 is a computing device that includes a processor circuit 704 for controlling operation of the controller 702 and for performing functions, such as those described herein with respect to method 600 of FIGS. 6A-6D. The controller 702 also includes a memory 706, e.g., a file system. An operating system 708, applications and other programs are stored on the memory 706 for running or operating on the processor circuit 704. One or more operation modules 710, 712 or systems are also stored on the memory 706 and are compiled and run on the processor circuit 704 to perform the functions or operations described herein. The press operation module 710 and robot operation module 712 are any type of software hardware or combination of hardware and software for operating a respective movable gantry press or robot, or other features described herein. In this embodiment, the press operation module 710 is configured to manage position, status, pressure, dwell, equipment condition, maintenance tracking, press movement, and safety monitoring and feedback for the press. The robot operation module 712 is configured to manage position, status, equipment condition, clamping, and load for the robot. These or other modules may also manage other functions, such as an operator interface, product priority scheduling, positions and statuses for all equipment, data capture for all equipment, maintenance tracking, and quality assurance tracking for the system, and thermal controls, such as temperature monitoring and status, thermocoupling, and equipment condition.

The controller 702 also includes one or more input devices, output devices or combination input/output devices, collectively I/O devices 720. The I/O devices 720 include, but are not necessarily limited to, a gantry press communication interface, a robot communication interface, a keyboard or keypad, pointing device, such as a mouse, disk drive and any other devices to permit a user to interface with and control operation of the controller 702 and to access the operation modules 710, 712 or other features. In accordance with an embodiment, at least one of the I/O devices 720 is a device to read a computer program product, such as computer program product 722. The operation modules 710, 712 are loaded on the memory 706 from a computer program product, such as computer program product 722.

A member of a network or user 723 of the computing system 700 may access the controller 702 operation modules 710, 712. The user 723 may access the controller 702 directly, or may use a client computer system 724 or communications device, such as a mobile or handheld computer or communications device, to remotely operate the controller 702 via a network 736 for example.

Each of the movable gantry press 214 and robots 226, 727 in this example also includes a processor device 728 that communicates with the respective press operation module 710 and robot operation module 712 of the controller 702. In some embodiments, the movable gantry press 214 or robots 226, 727 may be operated partially or fully independently of each other.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations or block diagrams of methods, apparatuses (systems) and computer program products according to embodiments of the disclosure. It will be understood that each block of the flowchart illustrations or block diagrams, and combinations of blocks in the flowchart illustrations or block diagrams, can be implemented by machine-readable instructions, e.g., computer program instructions. These machine-readable instructions may be provided to a processor of a general-purpose computer, special purpose computer, or other programmable data processing apparatus to produce a machine, such that the instructions, which execute via the processor of the computer or other programmable instruction execution apparatus, create a mechanism for implementing the functions or acts specified in the flowchart or block diagram block or blocks.

These machine-readable instructions may also be stored in a transitory or non-transitory computer readable medium that when executed can direct a computer, other programmable data processing apparatus, or other devices to function in a particular manner, such that the instructions when stored in the computer readable medium produce an article of manufacture including instructions which when executed, cause a computer to implement the function or act specified in the flowchart or block diagram block or blocks. The machine-readable instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions or acts specified in the flowchart or block diagram block or blocks. The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams or flowchart illustration, and combinations of blocks in the block diagrams or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and "comprising," when used in this specification, specify the presence of stated features, steps, operations, elements, or components, but do not preclude the presence or addition of one or more other features, steps, operations, elements, components, or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way or combination, and the present specification, including the drawings, shall be construed to constitute a complete written description of all combinations and subcombinations of the embodiments described herein, and of the manner and process of making and using them, and shall support claims to any such combination or subcombination.

The invention claimed is:

1. A system for fabricating finished parts, the system comprising:

a plurality of die assemblies located at a plurality of respective locations, each die assembly being configured to fabricate a respective finished part, each die assembly comprising an upper die section and a lower die section;

a movable gantry press configured to move between the plurality of respective locations and selectively operate the plurality of die assemblies;

a first robot configured to move between the plurality of respective locations and load a respective blank into each die assembly of the plurality of die assemblies; and a controller configured to:

receive a first input to fabricate a first finished part;

identify a first die assembly of the plurality of die assemblies;

instruct the movable gantry press to move to the location of the first die assembly;

instruct the movable gantry press to lift the upper die section of the first die assembly;

instruct the first robot to move to the location of the first die assembly;

after the movable gantry press has lifted the upper die section of the first die assembly, instruct the first robot to load a first blank into the first die assembly;

after the first robot has loaded the first blank into the first die assembly, instruct the movable gantry press to lower the upper die section of the first die assembly; and instruct the movable gantry press to operate the first die assembly to compress the first blank between the upper die section and the lower die section of the first die assembly to fabricate the first finished part.

2. The system of claim 1 further comprising a press rail system, the movable gantry press configured to traverse the press rail system to access each die assembly of the plurality of die assemblies.

3. The system of claim 1 further comprising a robot rail system, the first robot configured to traverse the robot rail system to access each die assembly of the plurality of die assemblies.

4. The system of claim 1, further comprising a second robot configured to move between the plurality of respective locations and remove the respective finished part from each die assembly of the plurality of die assemblies, the controller further configured to:

instruct the second robot to move to the location of the first die assembly; and instruct the second robot to remove the first finished part from the first die assembly.

5. The system of claim 1, wherein the controller is further configured to:

receive a second input to fabricate a second finished part;

identify a second die assembly of the plurality of die assemblies;

instruct the movable gantry press to move to the location of the second die assembly;

instruct the first robot to move to the location of the second die assembly;

instruct the first robot to load a second blank into the second die assembly; and instruct the movable gantry press to operate the second die assembly to fabricate the second finished part.

6. The system of claim 5, wherein the first finished part has a first shape and the second finished part has a second shape different from the first shape.

7. The system of claim 1, wherein each upper die section of each die assembly comprises a plurality of upper die segments, and wherein each lower die section of each die assembly comprises a plurality of lower die segments.

8. The system of claim 1, wherein the movable gantry press further comprises an actuator comprising:

at least one electric motor; and at least one ballscrew configured to be driven by the at least one electric motor to, for each die assembly, apply a force to the upper die section of the die assembly to compress the respective blank between the upper die section and the lower die section of the die assembly.

9. The system of claim 1, further comprising a plurality of heating elements disposed in the plurality of die assemblies, the plurality of heating elements configured to, for each die assembly, heat at least one of the upper die section or the lower die section of the die assembly to at least a predetermined temperature.

10. The system of claim 9, wherein the predetermined temperature is at least about 900 degrees F.

11. A method for forming finished parts, comprising:

receiving, at a controller, a first input to fabricate a first finished part;

identifying, by the controller, a first die assembly of a plurality of die assemblies located at a plurality of respective locations, each die assembly being configured to fabricate a respective finished part, each die assembly comprising an upper die section and a lower die section;

moving a movable gantry press to the location of the first die assembly;

causing, by the controller, the movable gantry press to lift the upper die section of the first die assembly;

moving a first robot to the location of the first die assembly;

causing, by the controller, the first robot to load a first blank into the first die assembly;

causing, by the controller, the movable gantry press to lower the upper die section of the first die assembly; and causing, by the controller, the movable gantry press to operate the first die assembly to compress the first blank between the upper die section and the lower die section of the first die assembly to fabricate the first finished part.

12. The method of claim 11, further comprising:

moving a second robot to the location of the first die assembly; and after causing the movable gantry press to operate the first die assembly to fabricate the first finished part, causing the second robot to remove the first finished part from the first die assembly.

13. The method of claim 11, further comprising:

receiving, at the controller, a second input to fabricate a second finished part;

identifying, by the controller, a second die assembly of the plurality of die assemblies;

moving the movable gantry press to the location of the second die assembly;

moving the first robot to the location of the second die assembly;

causing the first robot to load a second blank into the second die assembly; and causing the movable gantry press to operate the second die assembly to fabricate the second finished part.

14. The method of claim 13, wherein the first finished part has a first shape and the second finished part has a second shape different from the first shape.

15. The method of claim 11, further comprises:

actuating an actuator of the movable gantry press to compress the first blank between the upper die section and the lower die section of the first die assembly to fabricate the first finished part.

16. The method of claim 11, wherein causing the movable gantry press to lift the upper die section of the first die assembly further comprises causing the movable gantry press to releasably couple to the upper die section of the first die assembly.

17. The method of claim 10, wherein causing the movable gantry press to lift the upper die section of the first die assembly further comprises causing the movable gantry press to releasably couple to the upper die section of the first die assembly, the method further comprising:

before moving the movable gantry press to the location of the second die assembly, causing, by the controller, the movable gantry press to decouple from the upper die section of the first die assembly; and before causing the first robot to load a second blank into the second die assembly, causing the movable gantry press to:

releasably couple to the upper die section of the second die assembly; and lift the upper section of the second die assembly.

18. A method for forming finished parts, comprising:

receiving, at a controller, a first input to fabricate a first finished part;

identifying, by the controller, a first die assembly of a plurality of die assemblies located at a plurality of respective locations, each die assembly being configured to fabricate a respective finished part;

moving a movable gantry press to the location of the first die assembly;

causing, by the controller, the movable gantry press to lift a first upper die section of the first die assembly;

loading a first blank into the first die assembly;

causing, by the controller, the movable gantry press to operate the first die assembly to compress the first blank between the first upper die section and a first lower die section of the first die assembly to fabricate the first finished part; receiving, at the controller, a second input to fabricate a second finished part; identifying, by the controller, a second die assembly of the plurality of die assemblies; moving the movable gantry press to the location of the second die assembly; causing, by the controller, the movable gantry press to lift a second upper die section of the second die assembly, loading a second blank into the second die assembly; and causing the movable gantry press to operate the second die assembly to fabricate the second finished part.

19. The method of claim 18, further comprising:

before causing the movable gantry press to lift the first upper die section of the first die assembly, causing the movable gantry press to couple to the first upper die section of the first die assembly;

before moving the moving the movable gantry press to the location of the second die assembly, causing the movable gantry press to decouple from the first upper die section of the first die assembly; and before causing the movable gantry press to lift the second upper die section of the second die assembly, causing the movable gantry press to couple to the second upper die section of the first die assembly.

* * * * *